US008387186B2

(12) United States Patent
Yu

(10) Patent No.: US 8,387,186 B2
(45) Date of Patent: Mar. 5, 2013

(54) ASSEMBLY KIT GROUP

(76) Inventor: Ming Ming Yu, Taoyuan (TW)

( * ) Notice: Subject to any disclaimer, the term of this patent is extended or adjusted under 35 U.S.C. 154(b) by 0 days.

(21) Appl. No.: 13/188,891

(22) Filed: Jul. 22, 2011

(65) Prior Publication Data

US 2012/0181834 A1 Jul. 19, 2012

(30) Foreign Application Priority Data

Jan. 18, 2011 (TW) ..... 100101718 A

(51) Int. Cl.
*A47C 4/54* (2006.01)
*A47C 27/08* (2006.01)

(52) U.S. Cl. ..... 5/654; 5/657; 5/644; 5/630; 297/219.1; 297/228.1; 297/228.13

(58) Field of Classification Search ..... 5/652–654, 5/657, 657.5, 490, 737, 738, 499, 402–404, 5/630, 640, 636, 491, 655; 297/218.1, 218.4, 297/218.5, 225, 226, 219.1, 228.1, 228.13
See application file for complete search history.

(56) References Cited

U.S. PATENT DOCUMENTS

| | | | | |
|---|---|---|---|---|
| 2,032,248 | A * | 2/1936 | Bins | 119/482 |
| 3,848,281 | A * | 11/1974 | Mathews | 5/636 |
| 5,930,854 | A * | 8/1999 | O'Neill et al. | 5/655 |
| 6,089,668 | A * | 7/2000 | Peterson | 297/452.41 |
| 2007/0204406 | A1 * | 9/2007 | Thisse et al. | 5/655.3 |

* cited by examiner

*Primary Examiner* — Michael Trettel
(74) *Attorney, Agent, or Firm* — Cheng-Ju Chiang

(57) ABSTRACT

A kind of assembly kit group, for use as a back cushion, a sitting cushion, and a sitting cushion having a rotatable base, with a sitting cushion cover set to cover the outside section of a cushion body, and this cushion body having a concave hole in the central section, then a combining element combines to the inside of the concave hole in the central section position of the cushion body, so as to allow the central section position of this sitting cushion cover to slide into the inside of this concave hole.

11 Claims, 4 Drawing Sheets

ASSEMBLY KIT GROUP

BACKGROUND OF THE INVENTION

1. Field of the Invention

This invention being a kind of assembly kit group, more specifically a sitting cushion cover set to cover the outside section of a cushion body, then a combining element combines to the inside of the concave hole in the central section position of the cushion body, to conveniently allow the sitting cushion cover to be assembled and removed from the assembly kit group.

2. Description of Related Art

The central section position of the cushion body in a conventional rotatable seat has a concave hole set thereon, and the cushion body is disc-shaped, therefore the whole of the conventional rotatable seat forms a circular shape.

Because sellers cover the cushion body with a sitting cushion cover to prevent the cushion body from easily becoming dirty, and the sitting cushion cover is directly sewn onto the cushion body, so as to allow the cushion cover to completely attach to the surface of the cushion body, and the whole conventional rotatable seat thus forms a circular shape. Though it's hard to get the cushion body dirty because of the sitting cushion cover sewn thereon and covering the cushion body, the sitting cushion cover cannot be easily cleaned and replaced once the sitting cushion cover gets dirty.

If the sitting cushion cover is not sewn onto the cushion body, but set to directly cover the cushion body, the sitting cushion cover can be cleaned and replaced after getting dirty, however, the central portion of the sitting cushion cover has no way of being inserted into the concave hole set in the central portion of the cushion body.

Therefore, how to provide a kind of assembly kit group, for allowing the central section position of the sitting cushion cover to be able to be inserted into the concave hole set in the central section position of the cushion body when the sitting cushion cover is set on the cushion body, thereby allowing the sitting cushion cover to be removed for replacement and cleaning, is still an issue the industry needs to resolve.

SUMMARY OF THE INVENTION

The purpose of this invention is to provide a kind of assembly kit group, for respective use as a back cushion, a sitting cushion, and a sitting cushion having a rotatable base, with a sitting cushion cover set on the cushion body, then a combining element combines to the inside of the concave hole in the central section position of the cushion body, so as to allow the central section position of this sitting cushion cover to be inserted into the inside of this concave hole, thereby allowing the cushion body to fully present the originally designed pattern and allow the sitting cushion cover to be easily assembled and removed through the combining element and achieve the purposes of being replaced and cleaned once the sitting cushion cover becomes dirty, so as to improve upon the drawback of the conventional technique of sewing the sitting cushion kit on the cushion body, which is unable to be replaced and cleaned once the seat cushion kit becomes dirty.

The technical means of achieving the above mentioned purpose of the invention is: a sitting cushion cover set to cover the outside section of a cushion body, and the central section position of the cushion body having a concave hole; a combining element combining to the inside of the concave hole in the central section position of the cushion body, so as to allow the central section position of this sitting cushion cover to be inserted into the inside of this concave hole.

BRIEF DESCRIPTION OF THE DRAWINGS

The invention, as well as its many advantages, may be further understood by the following detailed description and drawings in which.

DETAILED DESCRIPTION OF THE INVENTION

Figure 1:
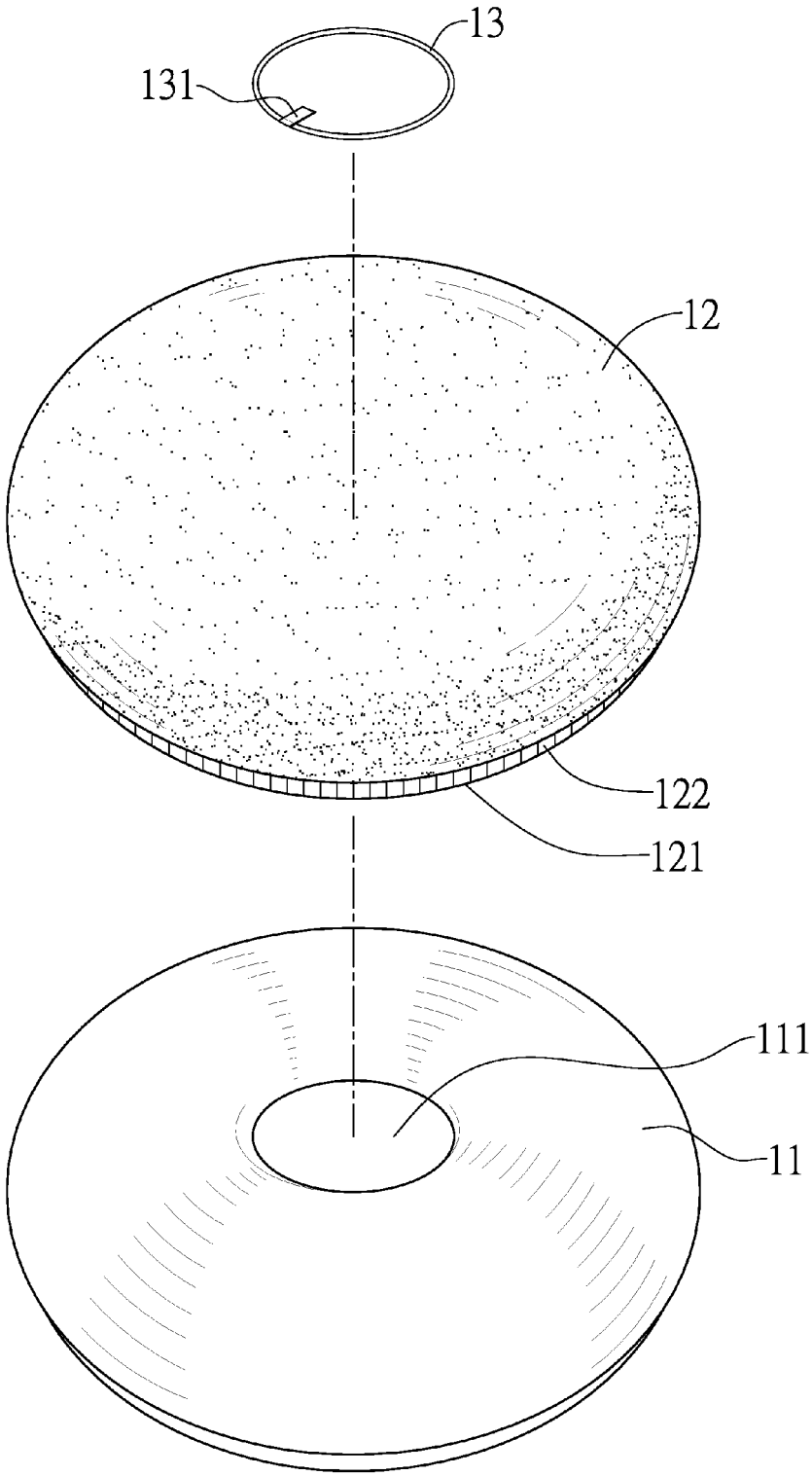
FIG. 1 is an exploded diagram showing the first embodiment of the assembly kit group of the present invention.

Please refer to FIG. 1 to FIG. 4, the invention provides an assembly kit group used for a back cushion, a sitting cushion, and a sitting cushion having a rotatable base, a sitting cushion cover 12 set to cover the outside section of a cushion body 11, and a combining element 13 combining to the inside of the concave hole 111 in the central section position of the cushion body 11, so as to allow the central section position of the sitting cushion cover 12 to slide into the inside of the concave hole 111.

In this embodiment, the combining component 13 is a round shaped frame, having a diameter which is smaller than the diameter of the concave hole 111 of the cushion body 11.

In this embodiment, the sitting cushion cover 12 has an opening 121 able to be set on the cushion body 11, and the tightness of the opening 121 can be further adjusted by selecting an elastic webbing 122 or a drawstring 123.

In this embodiment, a tab 131 is set on the combining element 13 for convenient removal In this embodiment, the outside of the cushion body 11 is one selected from a flat surface or an irregular surface.

Figure 2:
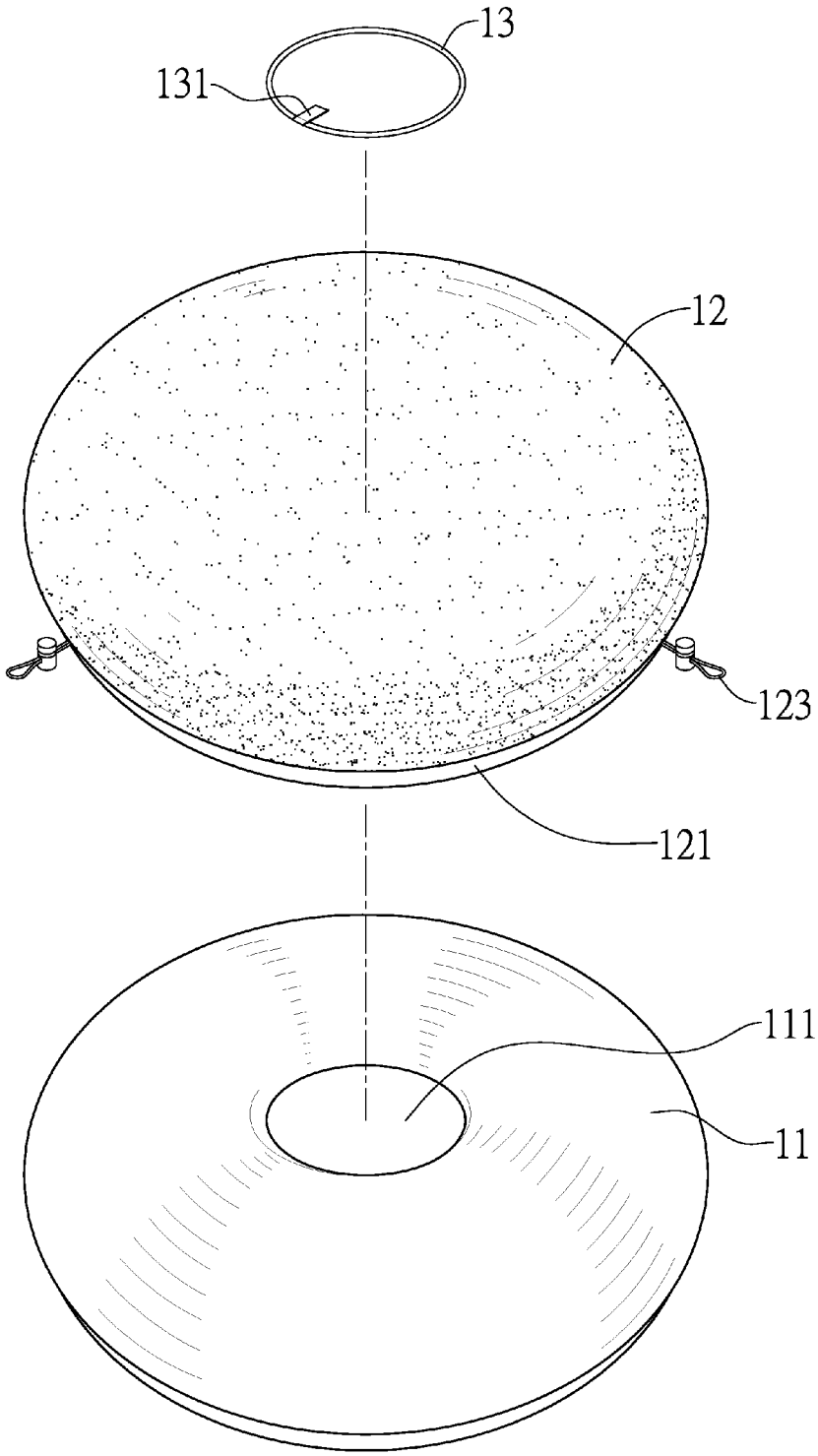
FIG. 2 is an exploded diagram showing the second embodiment of the assembly kit group of the present invention.
Figure 3:
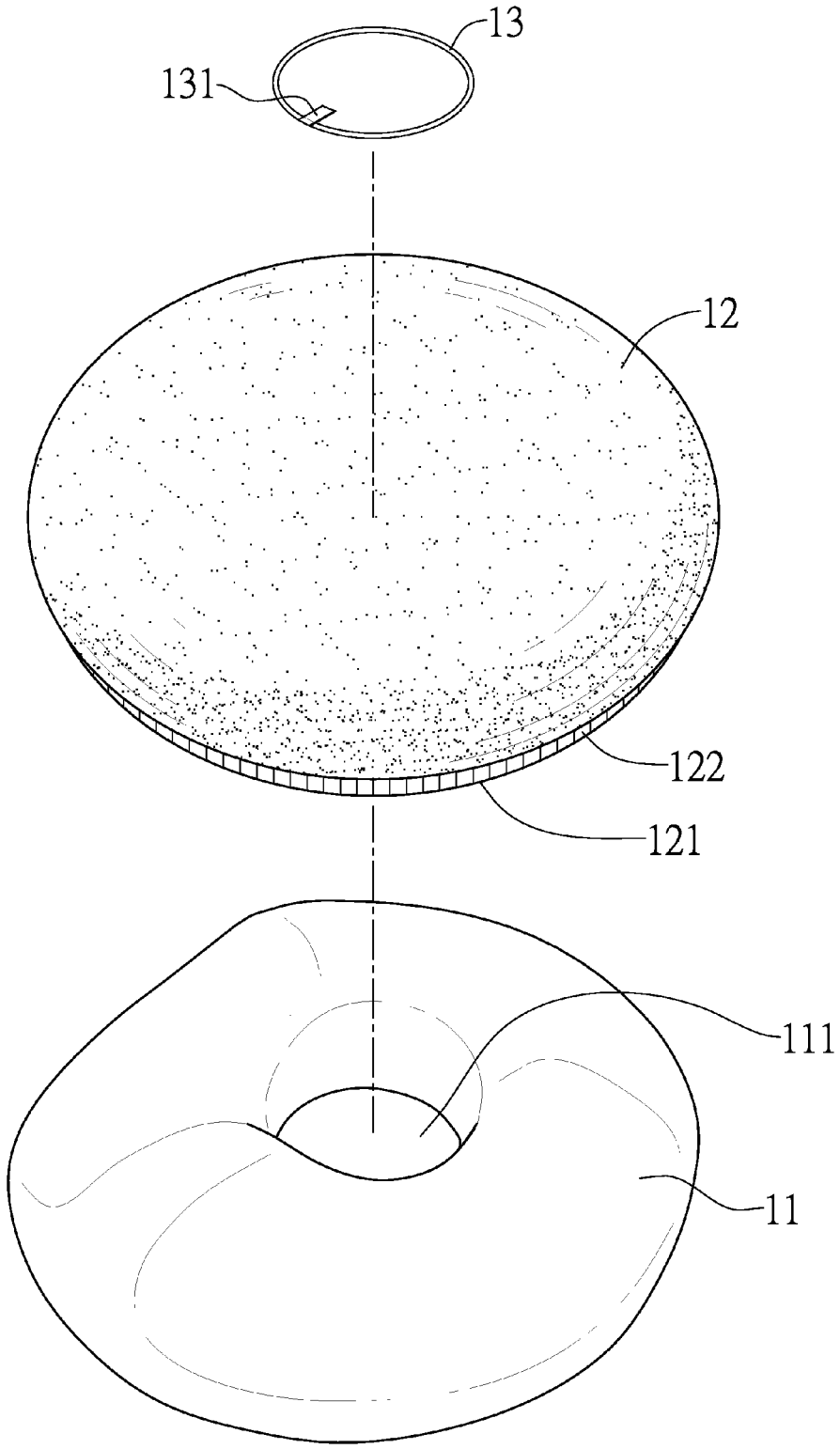
FIG. 3 is an exploded diagram showing the third embodiment of the assembly kit group of the present invention.
Figure 4:
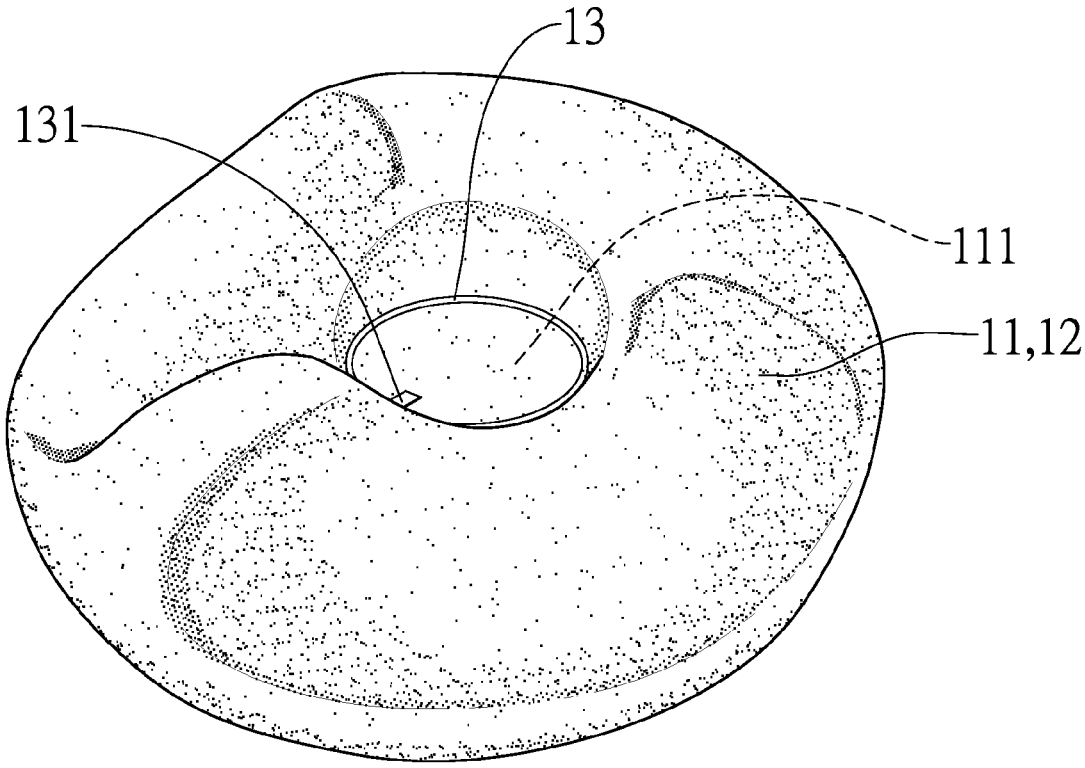
FIG. 4 is a combination diagram showing the assembly kit group of the present invention.

Before using the assembly kit group, firstly the opening 121 of the sitting cushion cover 12 faces the exterior of the cushion body 11 so as to allow the sitting cushion cover 12 to be set on the outside section of a cushion body 11, and the tightness of the opening 121 is able to be adjusted by an elastic webbing 122 or a drawstring 123 (as shown in FIG. 1 and FIG. 2) set in the opening 121, so as to fasten the sitting cushion cover on the cushion body 11, then pressing the combining element 13 downward from the central section position of the sitting cushion cover 12, so as to allow the central section position of the sitting cushion cover 23 to be inserted into the inside of this concave hole 111 set in the central section position of the cushion body 11, and as the combining element 13 is a frame body with a diameter smaller than the diameter of the concave hole 111 on the cushion body 11, therefore the sitting cushion cover 12 and the cushion body 11 are combined firmly through this combining element 13.

Furthermore, when the external surface of the cushion body 11 is produced as a flat or irregular surface, the sitting cushion cover 12 can be completely set on the flat surface or the irregular surface, then the combining element 13 combines the central section of the cushion cover 12 to the inside of the concave hole 111 in the center of cushion body 11, so that the cushion cover 12 completely covers the outside of this cushion body 11.

When removing the combining element 13 from the concave hole 111, users first pull on the tab 131 set on the combining element 13, and then pull the combing element 13 out of the concave hole 111 through pulling on tab 131, and after removing the combining element 13 from the concave hole 111, then pulling directly upwards on the opening 121 of the cushion cover 12 on the cushion body 11, (the opening 121 is used for adjusting the tightness of the elastic webbing 122) or adjusting the drawstring 123 of the opening 121 to be the loosest, and then pulling the opening 121 directly upwards to remove the sitting cushion cover 12 off the cushion body 11 for replacing and cleaning the sitting cushion cover 12.

Therefore, the assembly kit group of the invention is that the combining element 13 combines the central section position of the sitting cushion cover 12 covering the outside section of the cushion body 11 with the inside of this concave hole 111 in the central section position of the cushion body 11, so as to improve the conventional technology of sewing the sitting cushion cover 12 on the cushion body 11, so as to allow the sitting cushion cover 12 to be easily disassembled and removed through the combining element 13 to achieve the purposes of being replaced and cleaned once the sitting cushion cover becomes dirty, so as to improve upon the drawback of the conventional technique of sewing the sitting cushion kit 12 on the cushion body 11, which is unable to be replaced and cleaned once the seat cushion kit 12 becomes dirty Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An assembly kit group used for a back cushion, a sitting cushion, and a sitting cushion having a rotatable base, at least comprising:

a sitting cushion cover set on an outside section of a cushion body, and the cushion body having a concave hole in a central section position; and a combining element combining to the concave hole in the central section position of the cushion body, so as to allow a central section position of the sitting cushion cover to be inserted into the concave hole;

wherein the combining element is combined in the concave hole and located at a side of the sitting cushion cover opposite to a bottom of the concave hole along a longitudinal direction of the concave hole.

2. The assembly kit group of claim 1, wherein the combining element is a round shaped frame body, and a diameter of the frame body is smaller than a diameter of the concave hole of the cushion body.

3. The assembly kit group of claim 1, wherein the sitting cushion cover has an opening able to be set on the cushion body, and the opening is further fastened and loosened by one selected from an elastic webbing and a drawstring.

4. The assembly kit group of claim 1, wherein the combining element has a tab set for convenient removal.

5. The assembly kit group of claim 1, wherein the outside section of the cushion body is one selected from the group consisting of a flat surface and an irregular surface.

6. The assembly kit group according to claim 1, wherein the sitting cushion cover has an opening which is located at a side of the cushion body opposite to the concave hole when the sitting cushion cover is set on the cushion body.

7. An assembly kit group used for a back cushion, a sitting cushion, and a sitting cushion having a rotatable base, at least comprising:

a sitting cushion cover set on an outside section of a cushion body, and the cushion body having a concave hole in a central section position; and a combining element combining to the concave hole in the central section position of the cushion body, so as to allow a central section position of the sitting cushion cover to be inserted into the concave hole;

wherein the sitting cushion cover has an opening able to be set on the cushion body, and the opening is further fastened and loosened by one selected from an elastic webbing and a drawstring.

8. The assembly kit group of claim 7, wherein the combining element is a round shaped frame body, and a diameter of the frame body is smaller than a diameter of the concave hole of the cushion body.

9. The assembly kit group of claim 7, wherein the combining element has a tab set for convenient removal.

10. The assembly kit group of claim 7, wherein the outside section of the cushion body is one selected from the group consisting of a flat surface and an irregular surface.

11. An assembly kit group used for a back cushion, a sitting cushion, and a sitting cushion having a rotatable base, at least comprising:

a sitting cushion cover set on an outside section of a cushion body, and the cushion body having a concave hole in a central section position; and a combining element combining to the concave hole in the central section position of the cushion body, so as to allow a central section position of the sitting cushion cover to be inserted into the concave hole;

wherein the combining element has a tab set for convenient removal.

* * * * *